US005122126A

United States Patent [19]

Sakakiyama

[11] Patent Number: 5,122,126

[45] Date of Patent: Jun. 16, 1992

[54] NOZZLE MEMBER PROVIDED WITH SEALING MEMBRANE

[75] Inventor: Shoji Sakakiyama, Shinnanyo, Japan

[73] Assignee: Terumo Kabushiki Kaisha, Tokyo, Japan

[21] Appl. No.: 524,169

[22] Filed: May 15, 1990

[30] Foreign Application Priority Data

May 17, 1989 [JP] Japan ..... 1-123757

[51] Int. Cl.[5] ..... B65D 33/16

[52] U.S. Cl. ..... 604/415; 215/247

[58] Field of Search ..... 604/415; 215/249, 247, 215/232, 251, 253, 32; 220/DIG. 19, 277

[56] References Cited

U.S. PATENT DOCUMENTS

| | | | |
|---|---|---|---|
| Re. 31,082 | 11/1982 | Winchell | 215/232 |
| 3,682,315 | 8/1972 | Haller | 604/415 X |
| 4,153,173 | 5/1979 | Ward et al. | 215/247 X |
| 4,181,232 | 1/1980 | Bellamy et al. | 215/232 |
| 4,265,364 | 5/1981 | Baba | 215/249 |
| 4,279,352 | 7/1981 | Ward | 215/247 |
| 4,293,078 | 10/1981 | Percarpio et al. | 215/247 |
| 4,294,249 | 10/1981 | Sheehan et al. | 215/247 X |
| 4,307,766 | 12/1981 | Tonokura | 604/415 X |
| 4,445,896 | 5/1984 | Gianturco | 604/415 X |
| 4,478,342 | 10/1984 | Slater et al. | 215/355 X |
| 4,582,207 | 4/1986 | Howard et al. | 215/247 |
| 4,741,446 | 5/1988 | Miller | 215/247 |

FOREIGN PATENT DOCUMENTS

| | | | |
|---|---|---|---|
| 216031 | 3/1957 | Australia | 604/415 |
| 741281 | 1/1970 | Belgium | 604/415 |
| 0081976A1 | 6/1983 | European Pat. Off. . | |
| 1520522 | 3/1968 | France | 215/247 |
| 1558282 | 2/1969 | France . | |
| 1175428 | 12/1969 | United Kingdom | 215/247 |
| WO86/06043 | 10/1986 | World Int. Prop. O. . | |

*Primary Examiner*—Robert A. Hafer
*Assistant Examiner*—Kevin G. Rooney
*Attorney, Agent, or Firm*—Frishauf, Holtz, Goodman & Woodward

[57] ABSTRACT

A nozzle member is mounted to a medical solution container for providing an inlet port of an additional medical solution introduced into the container by means of a needle. The nozzle member comprises a tubular body and a synthetic resin sealing membrane mounted within the tubular body. Projections are formed on both surfaces in the central portion of the sealing membrane so as to prevent the sealing membrane from being strained or cracked in the step of thermally sterilizing the medical solution container.

16 Claims, 2 Drawing Sheets

NOZZLE MEMBER PROVIDED WITH SEALING MEMBRANE

Background of the Invention

1. Field of the Invention

The present invention relates to a nozzle member provided with a sealing membrane. The nozzle member is used as an injection port of, for example, a peritoneal dialysing fluid bag, a transfusion bag or a blood bag.

2. Description of the Related Art

The nozzle member of the present invention is used in, for example, a peritoneal dialysing fluid bag, which is shown in FIG. 1. FIG. 2 is a cross sectional view along line II—II shown in FIG. 1. As seen from the drawings, the bag comprises a bag body 10 prepared by heat-sealing the edge portion 12 of a soft polyvinyl chloride (PVC) sheet 11 manufactured by means of inflation molding. A dialysing fluid is housed in the inner space 13 of the bag body. A sealing tubular body 14 formed of PVC is mounted at the lower end portion of the bag body 10 so as to provide an outlet port. The tubular body 14 extending into the inner space 13 is fixed by fusion to the sheet 11. A conduit 16 is connected to the outer open end of the tubular body 14. The other end of the tubular body 14 positioned within the inner space 13 is sealed. Also, a constricted portion 15 is formed in that portion of the tubular body 14 which is positioned within the inner space 13 and close to the bottom of the bag body 10.

Further, a nozzle member 17 for injection of a medical solution into the bag is formed at the lower end portion of the bag body 10. The nozzle member 17 comprises a tubular body 17*a*, which is also formed of PVC, extends into the inner space 13 of the bag body 10, and is fixed to the PVC sheet 11 by fusion. The tubular body 17*a* is open at both ends. The lower open end of the tubular body 17*a* positioned outside the inner space 13 is hermetically closed by a rubber stopper 18. It should be noted that a sealing membrane member 19 formed of PVC is disposed inside the tubular body 17*a* and slightly above the lower end of the tubular body 17*a*. The present invention is directed to the nozzle member 17 comprising the sealing membrane member 19 and the tubular body 17*a*.

FIG. 3 is a cross sectional view showing the tubular body 17*a*, the sealing membrane member 19 and the rubber stopper 18 under the dismantled state. As seen from the drawing, the tubular body 17*a* and the sealing membrane member 19 are prepared as separate members. After injection of a peritoneal dialysing fluid from the tubular body 17*a* into the inner space 13 of the bag, the sealing membrane member 19 and the rubber stopper 18 are mounted to the tubular body 17*a*. Then, the bag 10 is sterilized within an autoclave. In this sterilizing step, the sealing membrane member 19 is thermally fused to the tubular body 17*a* so as to form an integral body. The dialysing fluid housed in the bag 10 is completely shielded from the outside until immediately before use of the dialysing fluid housed in the bag so as to maintain its sterility.

The peritoneal dialysis using the peritoneal dialysing fluid bag described above is carried out as follows. In the first step, the needle of a syringe is pierced through the rubber stopper 18 and the sealing membrane member 19 so as to mix a medical solution such as insulin or antibiotic into the dialysing fluid. Also, the tubular body 14 is picked up form above the bag body 10 so as to take away the upper portion 14*a* of the tubular body 14 from the constricted portion 15. As a result, the inner space 13 is allowed to communicate with the conduit 16 via the remaining portion of the tubular body 14 so a to permit outflow of the dialysing fluid housed in the bag 10. The bag under this condition is hung on a high position. Also, a catheter connected to the distal end of the conduit 16 is retained in an abdominal cavity of the patient. It follows that the dialysing fluid within the bag 10 is gravitationally introduced into the abdominal cavity of the patient. The dialysing fluid is retained within the abdominal cavity of the patient for a predetermined period of time so as to carry out dialysis through the peritoneum. After completion of the dialysis, the bag 10 is moved to a position lower than the position of the patient so as to discharge the used dialysing fluid into the bag 10.

The problem pointed out below remains unsolved in the nozzle member 17 comprising the sealing membrane member. Specifically, the main part of the sealing membrane member 19, which works as a sealing membrane, is formed very thin so as to facilitate the needle piercing in the step of mixing a medical solution into the dialysing fluid. The sealing membrane, which is very thin, tends to bear thermal strain in the step of sterilization within an autoclave. In some cases, cracks are formed in the sealing membrane by the thermal strain, making the membrane quite incapable of performing its function.

SUMMARY OF THE INVENTION

An object of the present invention is to prevent the sealing membrane from being strained or cracked in the step of thermally sterilizing the tubular body provided with the sealing membrane.

To achieve the object, a projection is formed in the present invention in the central portion of the sealing membrane.

According to the present invention, there is provided a nozzle member provided with a sealing membrane, comprising a tubular body, and a sealing membrane formed of a synthetic resin and mounted within the tubular body for the sealing purpose, a projection being formed on at least one surface in the substantially central portion of the sealing membrane.

In the present invention, it is desirable to form a projection on each surface of the sealing membrane. The tubular body and the sealing membrane, which are formed separately, may be attached to each other to form the nozzle member of the present invention. Alternatively, an integral structure comprising the tubular body and the sealing membrane may be prepared by molding.

The projection formed in the substantially central portion of the sealing membrane permits effectively preventing the membrane from being strained or cracked in the step of thermal sterilization, or permits markedly suppressing such strain or cracks. The reason for the prominent effect produced by the presence of the projection has not yet been clarified completely. It is considered reasonable to understand that the thickness of the sealing membrane is locally increased near the projection, leading to the prominent effect of the present invention.

The present invention, which provides a nozzle member provide with a sealing membrane, produces a prominent effect that the sealing membrane can be prevented from being strained or cracked in the step of thermally sterilizing a medical transfusion bag having the nozzle member mounted therein.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

Figure 4:
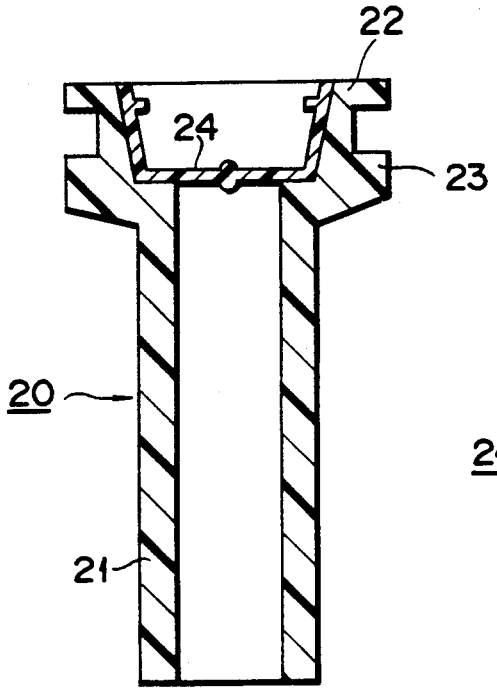
FIG. 4 is a cross sectional view showing a nozzle member provided with a sealing membrane according to a first embodiment of the present invention.

A nozzle member 20 provided with a sealing membrane according to a first embodiment of the present invention is shown in FIG. 4. As seen from the drawing, the nozzle member 20 comprises a tubular body 21 manufactured by injection molding of PVC. The tubular body 21 is open at both ends, and the inner diameter of the tubular body 21 is increased at the upper end portion. An upper flange 22 and a lower flange 23 are formed along the outer circumference of the tubular body 21 in the upper end portion. Also, a sealing membrane member 24 is provided in the upper end portion having a larger inner diameter of the tubular body 21.

Figure 5:
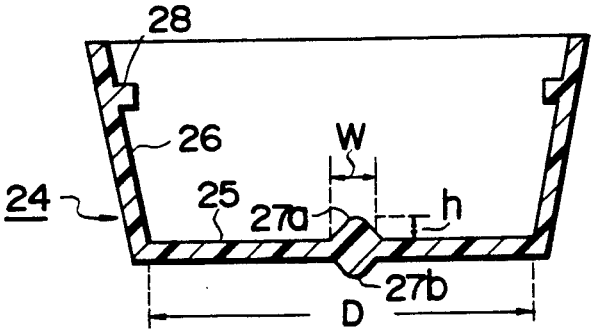
FIG. 5 is a cross sectional view showing the sealing membrane included in the nozzle member shown in FIG. 4.

FIG. 5 shows in a magnified fashion the sealing membrane member 24. It is seen that the member 24 comprises a sealing membrane 25 and a side wall 26. The membrane 25 is 0.7 mm thick, and conical projections 27*a*, 27*b* are formed in the central portion of the membrane 25. Also, an inward annular projection 28 is formed in the upper portion of the side wall 26. The sealing membrane member is also formed by injection molding of PVC. The side wall 26 is brought into direct contact with the inner wall surface in the upper portion of the tubular body 21 for mounting the sealing membrane member 24 in the tubular body 21.

Figure 1:
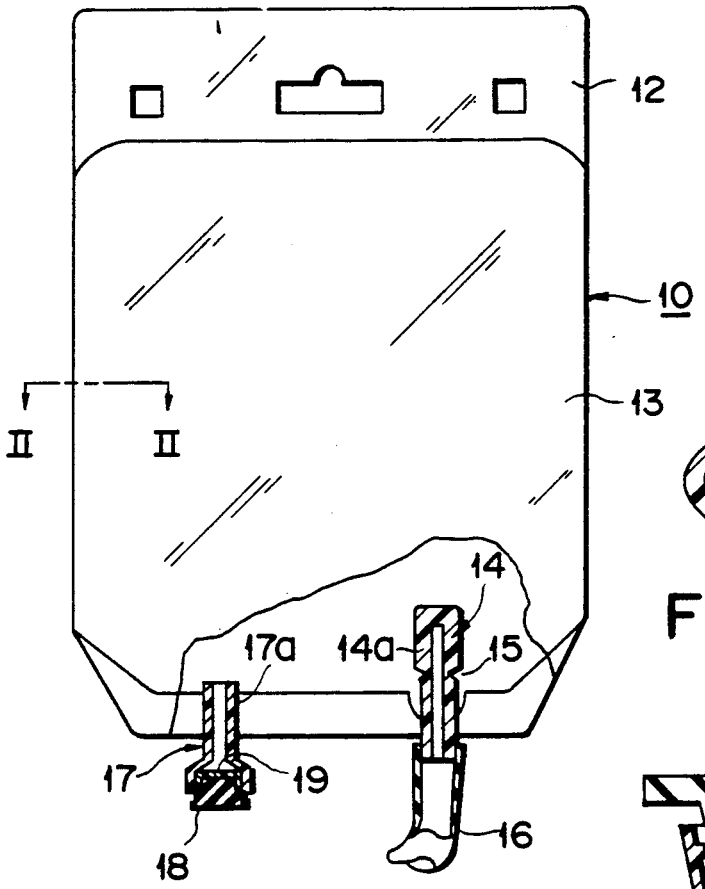
FIG. 1 (PRIOR ART)
FIG. 1 schematically shows a peritoneal dialysing fluid bag provided with a conventional nozzle member provided with a sealing membrane.
Figure 2:
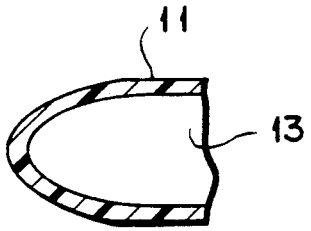
FIG. 2 (PRIOR ART)
FIG. 2 is a cross sectional view along line II—II shown in FIG. 1.
Figure 3:
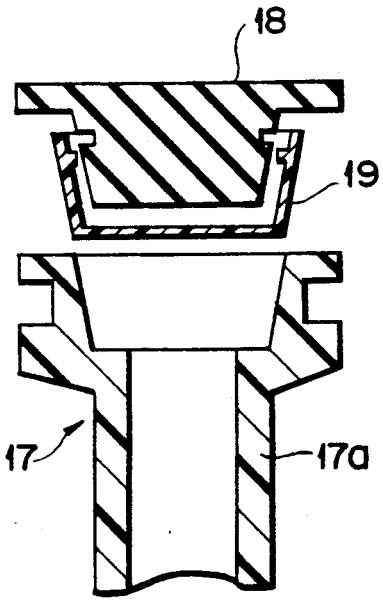
FIG. 3 (PRIOR ART)
FIG. 3 is a cross sectional view showing in a dismantled state the conventional nozzle member provided with a sealing membrane, said nozzle member being used in a peritoneal dialysing fluid bag.

The nozzle member 20 described above is mounted to a peritoneal dialysing fluid bag, as already described in conjunction with FIG. 1. The side wall 26 of the sealing membrane member is fused to the inner surface of the tubular body 21 in the sterilizing step carried out in an autoclave so as to form an integral structure. It has been confirmed that the sealing membrane 25 is prevented from being strained or cracked in the sterilizing step because of the presence of the projections 27*a*, 27*b* formed in the central portion of the membrane 25. It has also been confirmed that a satisfactory effect is obtained in the case where the diameter D of the sealing membrane 25 is 5 mm, the width w and the height h of the projections 27*a*, 27*b* are 1.5 mm and 0.5 mm, respectively.

Figure 6:
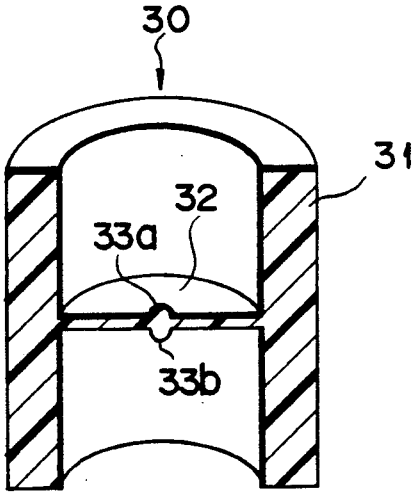
FIG. 6 is an oblique and cross sectional view showing a nozzle member provided with a sealing membrane according to a second embodiment of the present invention.

FIG. 6 shows a second embodiment of the present invention. It is seen that projections 33*a*, 33*b* are formed in the substantially central portion of a sealing membrane 32 formed within a tubular body 31. In this embodiment, the tubular body 31 has a uniform inner diameter. Also, the sealing membrane 32 and the tubular body 31 are integrally formed by injection molding.

The nozzle member 30 shown in FIG. 6 can also be used in the peritoneal dialysing fluid bag shown in FIG. 1. In this case, however, it is impossible to introduce a dialysing fluid into the bag through the tubular body 31, making it necessary to form separately an inlet port for introducing the dialysing fluid into the bag. The nozzle member 30 is adapted for use in, for example, a blood bag. Of course, the projections 33*a*, 33*b* permit the sealing membrane 32 from being strained or cracked in the thermal sterilization step.

Additional advantages and modifications will readily occur to those skilled in the art. Therefore, the invention in its broader aspects is not limited to the specific details, and representative devices, shown and described. Accordingly, various modifications may be made without departing from the spirit or scope of the general inventive concept as defined by the appended claims and their equivalents.

What is claimed is:

1. A thermally sterilizable nozzle member, comprising:

a tubular body;

a thin sealing membrane mounted within said tubular body and formed of a synthetic resin, and which is pierceable by a needle of a syringe; and a projection formed on at least one surface in a substantially central portion of said sealing membrane, said projection having a maximum diameter which is less than one third of an inner diameter of said tubular body where the sealing member is mounted to said tubular body so as to allow a needle to pierce said sealing membrane without rupturing said sealing membrane;

wherein said sealing membrane has opposite surfaces, and said projection is formed on each of said opposite surfaces of said sealing membrane.

2. The nozzle member of claim 1, wherein said tubular body and said sealing membrane are formed separately.

3. The nozzle member of claim 1, wherein said tubular body and said sealing membrane are formed integrally with each other.

4. The device of claim 1, wherein said projection has a diameter which is substantially smaller than the diameter of said sealing membrane.

5. A thermally sterilizable medical solution container device, comprising:

a container means, and a nozzle member for introducing a medical solution into said container means; and wherein:

said nozzle member comprises a tubular body;

a thin sealing membrane mounted within said tubular body and formed of a synthetic resin, and which is pierceable by a needle of a syringe; and a projection formed on at least one surface in a substantially central portion of said sealing membrane, said projecting having a maximum diameter which is less than one third of an inner diameter of said tubular body where the sealing membrane is mounted to said tubular body so as to allow a needle to pierce said sealing membrane without rupturing said sealing membrane;

wherein said sealing membrane has opposite surfaces, and said projection is formed on each of said opposite surfaces of said sealing membrane.

6. The device of claim 5, wherein said tubular body and said sealing membrane are formed separately.

7. The device of claim 5, wherein said tubular body and said sealing membrane are formed integrally with each other.

8. The device of claim 5, wherein said projection has a diameter which is substantially smaller than the diameter of said sealing membrane.

9. A thermally sterilizable medical solution container device, comprising:

a container means, and a nozzle member for introducing a medical solution into said container means; and wherein:

said nozzle member comprises a tubular body;

a thin sealing membrane mounted within said tubular body and formed of a synthetic resin, and which is pierceable by a needle of a syringe; and a projection formed on at least one surface in a substantially central portion of said sealing membrane, said projection having a maximum diameter which is less than one third of an inner diameter of said tubular body where the sealing member is mounted to said tubular body so as to allow a needle to pierce said sealing membrane without rupturing said sealing membrane;

wherein said projection is substantially conical and sized 0.3 to 0.7 mm in height and 1 to 2 mm in diameter at the bottom thereof.

10. The nozzle member of claim 9, wherein said tubular body and said sealing membrane are formed separately.

11. The nozzle member of claim 9, wherein said tubular body and said sealing membrane are formed integrally with each other.

12. The nozzle member of claim 9, wherein said sealing membrane has opposite surfaces, and said projection is formed on each of said opposite surfaces of said sealing membrane.

13. A thermally sterilizable nozzle member, comprising:

a tubular body;

a thin sealing membrane mounted within said tubular body and formed of a synthetic resin, and which is pierceable by a needle of a syringe; and a projection formed on at least one surface in a substantially central portion of said sealing membrane, said projection having a maximum diameter which is less than one third of an inner diameter of said tubular body where the sealing member is mounted to said tubular body so as to allow a needle to pierce said sealing membrane without rupturing said sealing membrane;

wherein said projection is substantially conical and sized to 0.3 to 0.7 mm in height and 1 to 2 mm in diameter at the bottom portion thereof.

14. The nozzle member of claim 13, wherein said sealing membrane has opposite surfaces, and said projection is formed on each of said opposite surfaces of sealing membrane.

15. The nozzle member of claim 13, wherein said tubular body and said sealing membrane are formed separately.

16. The nozzle member of claim 13, wherein said tubular body and said sealing membrane are formed integrally with each other.

* * * * *